US007957551B2

(12) United States Patent
Oda et al.

(10) Patent No.: US 7,957,551 B2
(45) Date of Patent: Jun. 7, 2011

(54) LOUDSPEAKER

(75) Inventors: Michitaka Oda, Mie (JP); Shinya Tabata, Mie (JP); Takenori Yamakawa, Mie (JP); Yasuhiro Nakanishi, Mie (JP)

(73) Assignee: Panasonic Corporation, Osaka (JP)

( * ) Notice: Subject to any disclaimer, the term of this patent is extended or adjusted under 35 U.S.C. 154(b) by 504 days.

(21) Appl. No.: 11/665,797

(22) PCT Filed: Dec. 21, 2005

(86) PCT No.: PCT/JP2005/023466

§ 371 (c)(1),
(2), (4) Date: Apr. 19, 2007

(87) PCT Pub. No.: WO2006/070659

PCT Pub. Date: Jul. 6, 2006

(65) Prior Publication Data

US 2009/0052725 A1 Feb. 26, 2009

(30) Foreign Application Priority Data

Dec. 27, 2004 (JP) ..... 2004-376044

(51) Int. Cl.
*H04R 25/00* (2006.01)

(52) U.S. Cl. ..... 381/412; 381/396

(58) Field of Classification Search ..... 381/396, 381/412, 414, 420

See application file for complete search history.

(56) References Cited

U.S. PATENT DOCUMENTS

| | | | |
|---|---|---|---|
| 5,583,945 | A | 12/1996 | Iijima et al. |
| 2002/0044671 | A1 | 4/2002 | Shimomura et al. |

FOREIGN PATENT DOCUMENTS

| | | |
|---|---|---|
| JP | 58-116390 | 8/1983 |
| JP | 3-61798 | 6/1991 |
| JP | 6-73989 | 10/1994 |
| JP | 6-296299 | 10/1994 |
| JP | 2002-010392 | 1/2002 |
| JP | 2002-095087 | 3/2002 |
| JP | 2002-335593 | 11/2002 |
| JP | 2003-329016 | 11/2003 |

*Primary Examiner* — Suhan Ni

(74) *Attorney, Agent, or Firm* — Wenderoth, Lind & Ponack, LLP.

(57) ABSTRACT

A loudspeaker includes the following components: a frame (5) that has a magnetic circuit (4) including a magnetic gap (4*a*) therein; and a diaphragm (6) that is bonded to a voice coil (7) fitted into the magnetic gap (4*a*) in the center thereof, and to the periphery of the frame (5) along the outer periphery thereof. The magnetic circuit (4) includes a yoke (1), a magnet (2), and a top plate (3). Tongue-shaped flanges (1*a*) are disposed at a substantially equidistant spacing in three positions to protrude from the top end face of the yoke (1). The total area of these tongue-shaped flanges (1*a*) in the three positions does not exceed a half of the total area corresponding to the flange part without flanges (1*a*). The frame (5) also includes engaging parts (5*a*) each for receiving one of the tongue-shaped flanges (1*a*) therein.

6 Claims, 5 Drawing Sheets

FIG. 5 – PRIOR ART
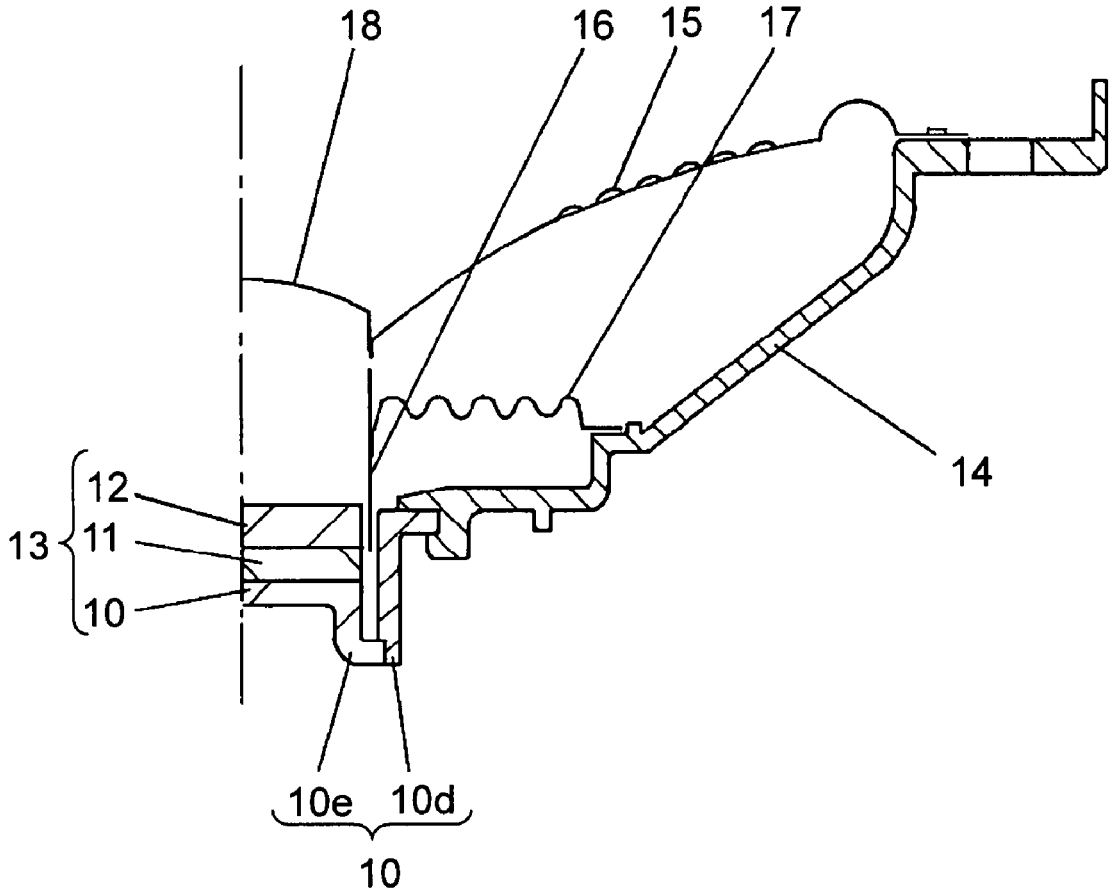

LOUDSPEAKER

This application is a U.S. national phase application of PCT International Application PCT/JP2005/023466, filed Dec. 21, 2005.

TECHNICAL FIELD

The present invention relates to loudspeakers for use in various kinds of acoustic equipment, and particularly to those appropriate for on-vehicle applications strongly requiring weight reduction.

BACKGROUND ART

For loudspeakers for use in various kinds of acoustic equipment, the technologies coping with conflicting demands of reduction in size and weight and improvement in performance caused by higher sound pressure and output have conventionally been pursued. Particularly for on-vehicle loudspeakers, weight reduction is strongly required to address recent global environmental conservation. For this purpose, a loudspeaker having the following structure is provided to meet these requirements. The loudspeaker includes a neodymium magnet having a high energy product in place of a conventional ferrite magnet, to downsize the magnetic circuit and thus considerably reduce the weight.

FIG. 5 is a semi-sectional view of a conventional loudspeaker of this kind. With reference to FIG. 5, cylindrical socket-shaped yoke 10 is separately formed into cylindrical outer peripheral part 10*d* and bottom part 10*e* and then joined together, to improve productivity. Magnet 11 made of neodymium is bonded to yoke 10. Top plate 12 is bonded to the top surface of magnet 11. Bonding yoke 10, magnet 11, and top plate 12 together forms magnetic circuit 13 including an annular magnetic gap therein.

Frame 14 made of resin has magnetic circuit 13 joined to the bottom surface of the frame. The outer periphery of diaphragm 15 is joined to the periphery of frame 14. Voice coil 16 is joined to the center of diaphragm 15 and fitted into the magnetic gap formed in magnetic circuit 13. Damper 17 is bonded to voice coil 16 to support the voice coil. Dustproof cap 18 is disposed in the center of diaphragm 15.

FIGS. 6A through 6C show how yoke 10 and frame 14 are joined to each other. FIG. 6A shows a bottom view of an essential part of yoke 10. FIG. 6B is a bottom view of an essential part of frame 14. FIG. 6C is a bottom view of an essential part of frame 14 having yoke 10 joined thereto.

With reference to FIG. 6A, along the outer periphery of the top end face of yoke 10 made of a magnetic metallic material, a plurality of notches 10*a* and protrusions 10*b* are disposed at a substantially equidistant spacing. Further, one of protrusions 10*b* has outward projection 10*c*.

With reference to FIG. 6B, frame 14 includes clips 14*a* for receiving notches 10*a* in yoke 10 of FIG. 6A, and recess 14*b* for engaging with projection 10*c* of yoke 10 of FIG. 6A.

First, yoke 10 and frame 14 structured as above are combined so that clips 14*a* of frame 14 match with notches 10*a* in yoke 10. Next, as shown in FIG. 6C, yoke 10 is rotated so that protrusions 10*b* of yoke 10 are rotated under lips 14*a* of frame 14 and the clips prevent yoke 10 from disengaging from frame 14. Projection 10*c* of yoke 10 fitted into recess 14*b* in frame 14 during such rotation of yoke 10 forms rotation stop means. Holding protrusions 10*b* of the yoke under clips 14*a* of frame 14 in this manner prevents yoke 10 from disengaging from frame 14.

Providing slight tapering in clips 14*a* of frame 14 on the side of protrusions 10*b* of yoke 10 allows clips 14*a* and protrusions 10*b* to be compressed by each other. In this case, the above rotation stop means can be eliminated.

In the conventional loudspeaker structured as above, the yoke and the frame, i.e. the magnetic circuit and the frame, of an on-vehicle loudspeaker having reduced size and weight can easily be joined to each other.

For example, Japanese Patent Unexamined Publication No. 2002-10392 is known as prior technical information related to the above invention.

The above conventional loudspeaker has a weight considerably smaller than that of a loudspeaker having a magnetic circuit of a ferrite magnet. However, in recent commitment of the automobile industry to global environmental conservation, weight reduction is pursued on the order of grams. Particularly for a magnetic circuit combining metallic materials, further weight reduction is required.

SUMMARY OF THE INVENTION

A loudspeaker of the present invention includes: a magnetic circuit having a magnetic gap; a frame made of resin and having the magnetic circuit joined to the bottom surface of the frame; and a diaphragm joined to a voice coil fitted into the magnetic gap in the center thereof, and to the periphery of the frame along the outer periphery thereof. The magnetic circuit includes a cylindrical socket-shaped yoke, a magnet disposed in the yoke, and a top plate disposed on the magnet.

Tongue-shaped flanges are disposed at a substantially equidistant spacing in three positions to partially protrude in the outer circumferential direction from the top end face of the yoke so that the total area of these tongue-shaped flanges in the three positions does not exceed a half of the total area corresponding to the flange part without the flanges. The frame also includes thereon engaging parts each for receiving the flange provided in the yoke while the top end face of the yoke is in contact with the bottom surface of the frame.

As obvious from the above description, the loudspeaker of the present invention has a simple structure in which the tongue-shaped flanges in the yoke are fitted into the engaging parts on the frame. Further, making the area of the tongue-shaped flanges as small as possible can reduce the weight of the loudspeaker. The present invention can provide a loudspeaker having smaller weight and higher performance and assembling workability.

BRIEF DESCRIPTION OF THE DRAWINGS

FIG. 5 is a semi-sectional view illustrating a structure of a conventional loudspeaker.

DETAILED DESCRIPTION OF PREFERRED EMBODIMENTS

Figure 1:
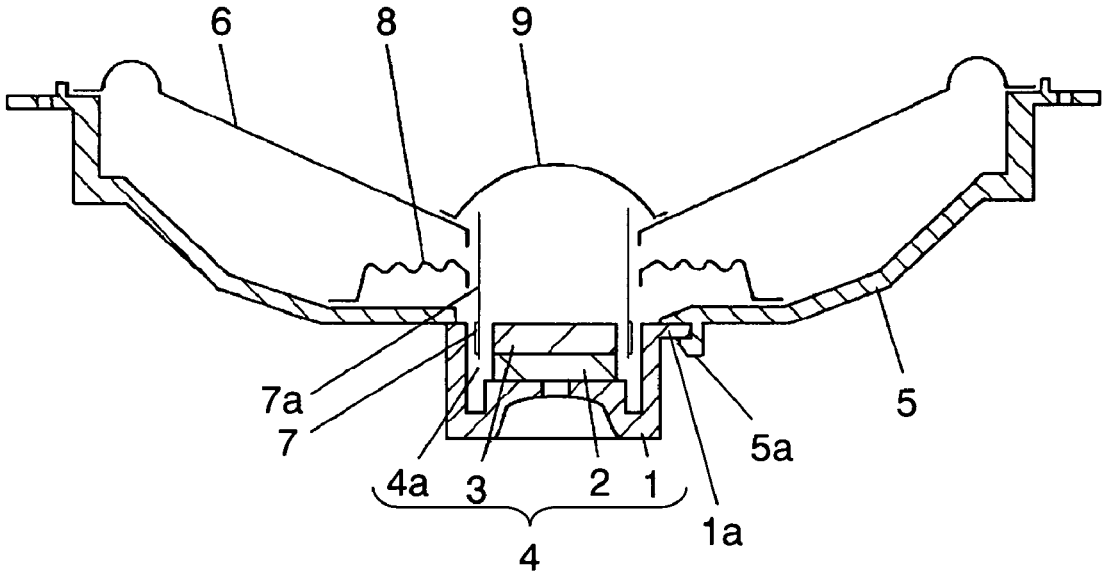
FIG. 1 is a sectional view illustrating a structure of a loudspeaker in accordance with an exemplary embodiment of the present invention.
Figure 2:
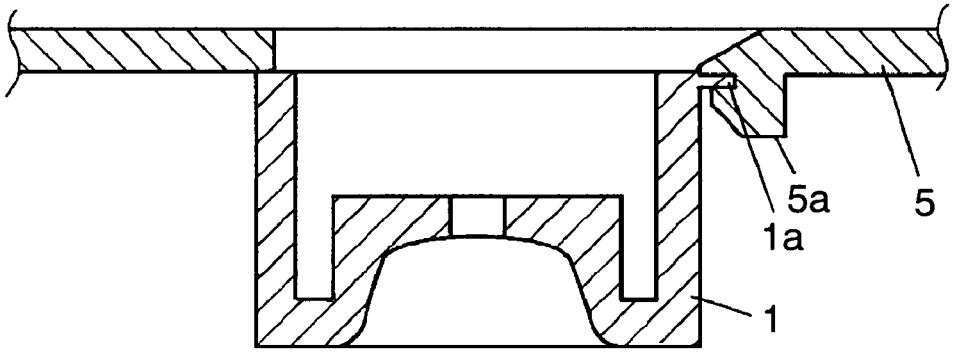
FIG. 2 is a sectional view of an essential part where a yoke and a frame of the loudspeaker of FIG. 1 are joined to each other.
Figure 3A:
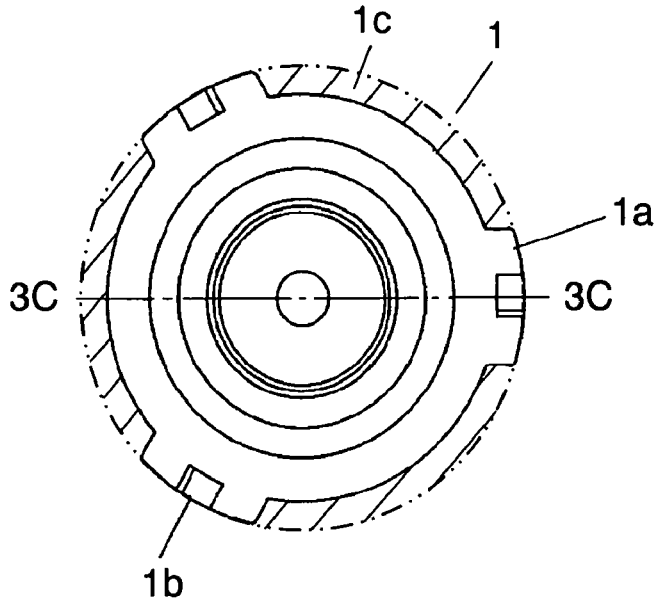
FIG. 3A is a plan view illustrating a structure of the yoke for use in the loudspeaker of FIG. 1.
Figure 3B:
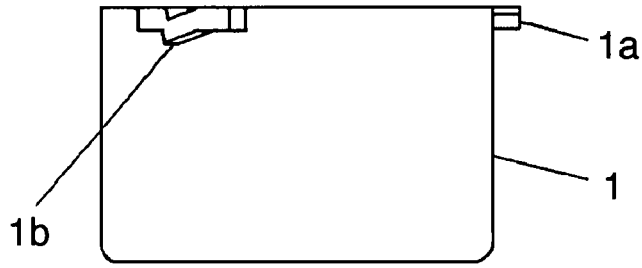
FIG. 3B is a front view illustrating a structure of the yoke for use in the loudspeaker of FIG. 1.
Figure 3C:
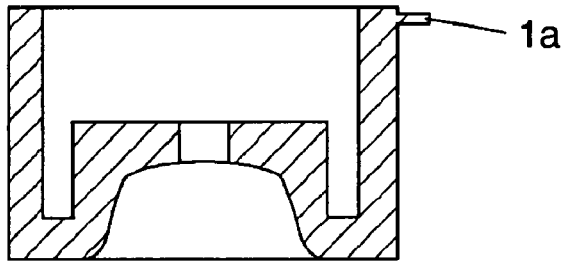
FIG. 3C is a sectional view of the yoke of FIG. 3A taken on line 3C-3C.
Figure 4A:
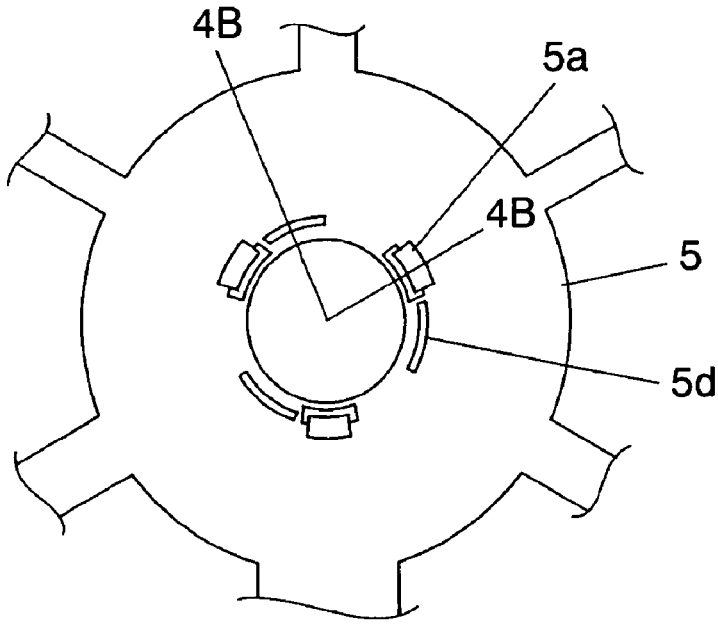
FIG. 4A is a bottom view of an essential part of a surface where the frame for use in the loudspeaker of FIG. 1A is joined to the yoke.
Figure 4B:
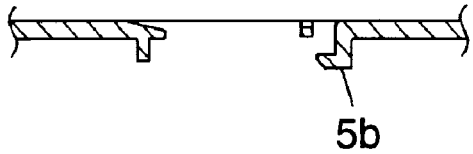
FIG. 4B is a sectional view of the frame of FIG. 4A taken on line 4B-4B.
Figure 4C:
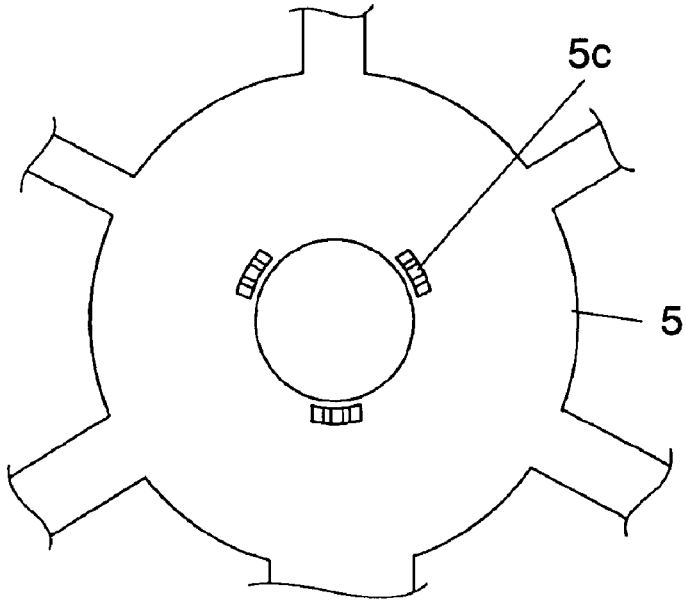
FIG. 4C is a plan view of an essential part of a backside of the surface where the frame for use in the loudspeaker of FIG. 1 is joined to the yoke.
Figure 6A:
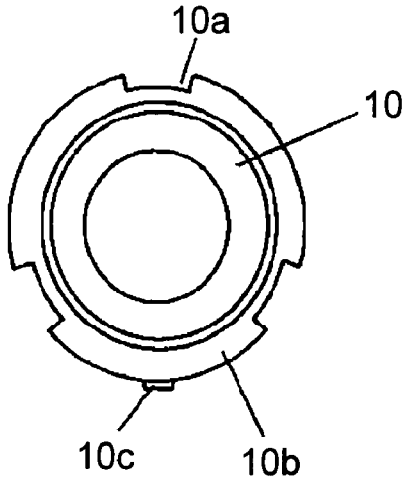
FIG. 6A PRIOR ART
FIG. 6A is a bottom view of an essential part of a yoke for use in the loudspeaker of FIG. 5.
Figure 6B:
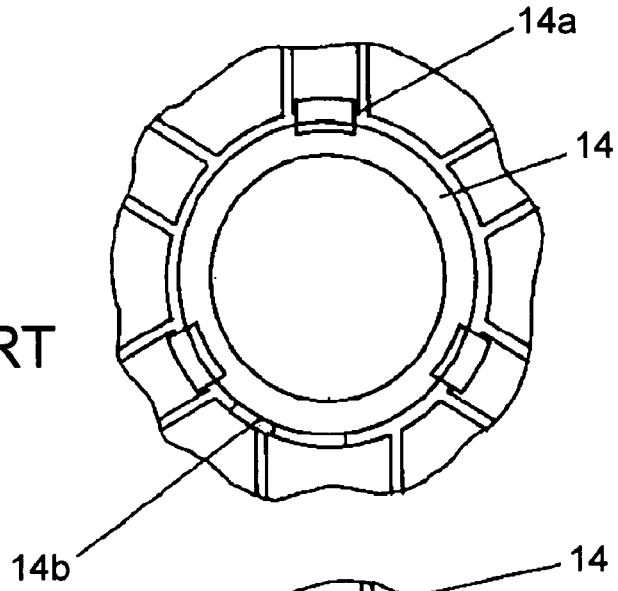
FIG. 6B PRIOR ART
FIG. 6B is a bottom view of an essential part of a frame for use in the loudspeaker of FIG. 5.
Figure 6C:
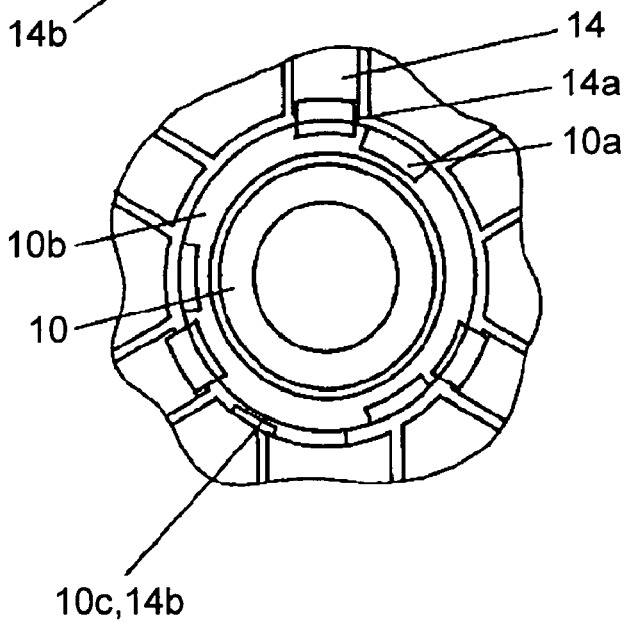
FIG. 6C PRIOR ART
FIG. 6C is a bottom view of an essential part of the frame of FIG. 6B having the yoke of FIG. 6A joined thereto.

Hereinafter, a description is provided of the exemplary embodiment of the present invention, with reference to the accompanying drawings. FIG. 1 is a sectional view illustrating a structure of a loudspeaker in accordance with the exemplary embodiment of the present invention. FIG. 2 is a sectional view of an essential part where the yoke and the frame of the loudspeaker of FIG. 1 are joined to each other. FIG. 3A is a plan view illustrating a structure of the yoke for use in the loudspeaker of FIG. 1. FIG. 3B is a front view illustrating a structure of the yoke for use in the loudspeaker of FIG. 1. FIG. 3C is a sectional view of the yoke of FIG. 3A taken on line 3C-3C. FIG. 4A is a bottom view of an essential part of a surface where the frame for use in the loudspeaker of FIG. 1A is joined to the yoke. FIG. 4B is a sectional view of the frame of FIG. 4A taken on line 4B-4B. FIG. 4C is a plan view of an essential part of a backside of the surface where the frame for use in the loudspeaker of FIG. 1 is joined to the yoke.

With reference to FIG. 1, a loudspeaker in accordance with the exemplary embodiment of the present invention is essentially structured of magnetic circuit 4 having magnetic gap 4*a* therein, frame 5 made of resin and having magnetic circuit 4 bonded to the bottom surface of the frame, and diaphragm 6 that is bonded to voice coil 7 fitted into magnetic gap 4*a* in the center thereof and to the periphery of frame 5 along the outer periphery thereof. Magnetic circuit 4 includes cylindrical socket-shaped yoke 1, magnet 2 disposed in yoke 1, and top plate 3 disposed on magnet 2. Tongue-shaped flanges 1*a* are disposed at a substantially equidistant spacing in three positions to partially protrude in the outer circumferential direction from the top end face of yoke 1. The total area of these tongue-shaped flanges 1*a* in the three positions does not exceed a half of the total area corresponding to the flange part without flanges 1*a*. The frame also includes thereon engaging parts 5*a* each for receiving tongue-shaped flange 1*a* provided in yoke 1 while the top end face of yoke 1 is in contact with the bottom surface of frame 5. Now, the flange part without tongue-shaped flanges 1*a* is a virtual portion of the flange part, i.e. the hatched portion in FIG. 3A.

A further detailed description is provided of the loudspeaker in accordance with the exemplary embodiment of the present invention. With reference to FIGS. 1 through 3C, yoke 1 is shaped like a socket. Magnet 2 made of neodymium is disposed in yoke 1. Top plate 3 is joined to the top surface of magnet 2. Yoke 1, magnet 2, top plate 3, and annular magnetic gap 4*a* form magnetic circuit 4.

Frame 5 made of resin is joined to yoke 1 on the bottom surface of the frame. The outer periphery of diaphragm 6 is bonded to the periphery of frame 5. Bobbin 7*a* of voice coil 7 is joined to the center of diaphragm 6. Voice coil 7 is fitted in magnetic gap 4*a* to be movable. Damper 8 is bonded to voice coil 7 to support the voice coil. Over the top surface of the center of diaphragm 6, dustproof cap 9 is provided.

Now, the structure of yoke 1 is further detailed with reference to FIGS. 3A through 3C. As shown in FIG. 3A, tongue-shaped flanges 1*a* are disposed at a substantially equidistant spacing in three positions to partially protrude in the outer circumferential direction from the top end face of yoke 1. The total area of these tongue-shaped flanges 1*a* in the three positions does not exceed a half of the total area corresponding to the flange part without flanges 1*a*. This structure makes the yoke as lightweight as possible. Preferably, tongue-shaped flanges 1*a* are formed in the three positions so that the total area thereof is as small as possible within the range in which the joining strength thereof can be ensured.

Protrusion 1*b* is provided on the backside of each tongue-shaped flange 1*a*. As shown in FIGS. 3A and 3B, one of the circumferential sides of this protrusion 1*b* has a gentle slope leading to the backside of tongue-shaped flange 1*a*. The other one of the circumferential sides has a steep slope leading to the backside of tongue-shaped flange 1*a*. With this structure, when the top end face of yoke 1 is pressed onto the bottom surface of frame 5 and rotated to join them together, placing the yoke so that the gentle slope side is in the clockwise direction facilitates fitting: Further, the steep slope side placed in the counter-clockwise direction offers an advantage that yoke 1 does not disengage from frame 5 easily. Now, the gentle slope is in the degree to which pressing the top end face of yoke 1 onto the bottom surface of frame 5 and rotating the yoke clockwise can easily join them together. The steep slope is in the degree to which yoke 1 does not disengage from frame 5 easily, but can be disengaged if needed.

Next, with reference to FIGS. 4A through 4C, a further detailed description is provided of the structure of frame 5. FIG. 4A is a bottom view of an essential part of a surface where the frame for use in the loudspeaker of FIG. 1A is joined to the yoke. FIG. 4B is a sectional view of the frame of FIG. 4A taken on line 4B-4B. FIG. 4C is a plan view of an essential part of the backside of the surface where the frame for use in the loudspeaker of FIG. 1 is joined to the yoke.

With reference to FIG. 4A, each of engaging parts 5*a* receives tongue-shaped flange 1*a* provided in yoke 1 of FIG. 3A for engagement. Each engaging part 5*a* includes inverted L-shaped columnar rib 5*b* integrally formed on the bottom surface of frame 5. The tip of rib 5*b* is in contact with the backside of tongue-shaped flange 1*a* of yoke 1. The parallel clearance formed between the tip of rib 5*b* and the bottom surface of frame 5 sandwiches tongue-shaped flange 1*a* provided in yoke 1.

Further, the tip of each rib 5*b* includes recess 5*c* for receiving protrusion 1*b* provided on tongue-shaped flange 1*a* of yoke 1. Protrusions 1*b* fitted into recesses 5*c* can securely join the yoke and the frame together. Further, with tongue-shaped flanges 1*a* of yoke 1 fitted into engaging parts 5*a*, one of the end faces of each tongue-shaped flange 1*a* is in contact with rotation stopper 5*d*.

For the loudspeaker of this exemplary embodiment structured as above, only pressing the top end face of yoke 1 onto the bottom surface of frame 5 and rotating the yoke clockwise can fit tongue-shaped flanges 1*a* in yoke 1 into engaging parts 5*a* on frame 5 for engagement. Thus, frame 5 and yoke 1 can be joined together easily. Further, protrusions 1*b* provided on tongue-shaped flanges 1*a* of yoke 1 and recesses 5*c* provided in engaging parts 5*a* on frame 5 can securely engage the yoke and frame with each other.

Each engaging part 5*a* including recess 5*c* can be dimensioned to be in resilient contact with tongue-shaped flange 1*a* including protrusion 1*b* in yoke 1 by making frame 5 of a resin. This structure allows tongue-shaped flange 1*a* to expand engaging part 5*a* and fit therein during engagement, thus further improving the joining strength. Further, the use of an adhesive during engagement allows engaging parts 5*a* and tongue-shaped flanges 1*a* to be joined to each other with extremely high reliability. As a result, a loudspeaker having smaller weight, and higher performance and assembling workability can stably be provided.

INDUSTRIAL APPLICABILITY

In the present invention, weight reduction of a magnetic circuit can provide a loudspeaker having smaller weight, and higher performance and assembling workability. For this reason, the loudspeaker is particularly useful as an on-vehicle loudspeaker or as a loudspeaker to be used in other fields requiring weight reduction.

The invention claimed is:

1. A loudspeaker comprising:

a magnetic circuit having a magnetic gap;

a frame made of resin and having the magnetic circuit joined to a bottom surface of the frame; and a diaphragm joined to a voice coil fitted into the magnetic gap in a center thereof, and to a periphery of the frame along an outer periphery thereof, wherein the magnetic circuit includes a cylindrical socket-shaped yoke, a magnet disposed in the yoke, and a top plate disposed on the magnet;

tongue-shaped flanges are disposed at a substantially equidistant spacing in three positions to partially protrude in an outer circumferential direction from a top end face of the yoke so that a total area of these tongue-shaped flanges in the three positions does not exceed a half of a total area corresponding to a flange part without the flanges; and the frame includes thereon engaging parts each for receiving a corresponding one of the tongue-shaped flanges provided in the yoke while the top end face of the yoke is in contact with the bottom surface of the frame.

2. The loudspeaker of claim 1, wherein each of the engaging parts includes an inverted L-shaped columnar rib integrally provided on the bottom surface of the frame so that a tip of the rib is in contact with a backside of a corresponding one of the tongue-shaped flanges; and parallel clearances, respectively formed between the tips of the ribs and the bottom surface, sandwich the tongue-shaped flanges.

3. The loudspeaker of claim 1, wherein rotation stoppers are provided on the frame so that one of end faces of each of the tongue-shaped flanges is in contact with a corresponding one of the rotation stoppers while the tongue-shaped flanges are fitted into the engaging parts.

4. The loudspeaker of claim 1, wherein each of the tongue-shaped flanges includes a protrusion on a backside thereof, and the engaging parts include thereon recesses each for receiving a corresponding one of the protrusions.

5. The loudspeaker of claim 4, wherein each of the protrusions includes, on one circumferential side thereof, a gentle slope leading to the backside of a corresponding one of the tongue-shaped flanges, and, on another circumferential side thereof, a steep slope leading to the backside of the tongue-shaped flange.

6. The loudspeaker of claim 1, wherein an adhesive is used to join the engaging parts and the tongue-shaped flanges to each other.

* * * * *